US010442214B2

(12) United States Patent
Condello et al.

(10) Patent No.: US 10,442,214 B2
(45) **Date of Patent: *Oct. 15, 2019**

(54) WATERLESS UV INKJET TRANSFER SYSTEM AND METHOD

(71) Applicant: XEROX CORPORATION, Norwalk, CT (US)

(72) Inventors: Anthony S. Condello, Webster, NY (US); Paul J. McConville, Webster, NY (US); Jack T. Lestrange, Macedon, NY (US); Chu-Heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 37 days.

This patent is subject to a terminal disclaimer.

(21) Appl. No.: 16/189,153

(22) Filed: Nov. 13, 2018

(65) Prior Publication Data

US 2019/0143716 A1 May 16, 2019

Related U.S. Application Data

(63) Continuation of application No. 15/809,720, filed on Nov. 10, 2017, now Pat. No. 10,155,401.

(51) Int. Cl.
*B41J 11/00* (2006.01)
*B41J 2/005* (2006.01)

(52) U.S. Cl.
CPC ..... *B41J 11/002* (2013.01); *B41J 2/0057* (2013.01)

(58) Field of Classification Search
CPC .... B41J 2/0057; B41J 11/002; B41J 11/0015; B41J 2/01; B41J 2002/012; B41J 29/38; B41J 2/04571; B41M 5/0256; B41M 7/0081; B41M 7/00; B41F 7/02; B41F 7/00; B41F 7/24
USPC ..... 347/100–103
See application file for complete search history.

(56) References Cited

U.S. PATENT DOCUMENTS

| | | | | |
|---|---|---|---|---|
| 9,138,985 | B1 | 9/2015 | Yang et al. | |
| 9,193,142 | B1 | 11/2015 | Moorlag et al. | |
| 10,155,401 | B1 * | 12/2018 | Condello | B41J 11/002 |
| 2017/0217150 | A1 | 8/2017 | Moore et al. | |
| 2018/0250929 | A1 | 9/2018 | Condello et al. | |

* cited by examiner

*Primary Examiner* — Jannelle M Lebron
(74) *Attorney, Agent, or Firm* — Caesar Rivise, PC

(57) ABSTRACT

A solid blanket receives a flood layer of very thin (e.g., about 10 μm or less) image receiving UV curable coating, which may be a clear, substantially clear, or tinted UV ink. A lower viscosity digital ink image may then be printed on top of the flood layer, for example by jetting UV ink on top of the flood layer. The lower viscosity UV digital ink sits on top of the thicker UV curable coating and maintains its location by surface tension interaction with the coating. The combination of ink and coating is then partially cured to a tacky state at which point it is transferred to print media via a conformable pressure nip. Since the lower viscosity jetted inks are not responsible for directly wetting the media, media latitude widens greatly. Further, no dampening fluid or fountain solution is needed to aid the transfer or the imaging.

20 Claims, 3 Drawing Sheets

WATERLESS UV INKJET TRANSFER SYSTEM AND METHOD

CROSS-REFERENCE TO RELATED APPLICATIONS

This application is a continuation of U.S. patent application Ser. No. 15/809,720, filed Nov. 10, 2017, which is titled "Waterless UV Inkjet Transfer System and Method".

FIELD OF DISCLOSURE

This invention relates generally to ink-based digital printing systems, and more particularly, to inkjet printing systems and methods for digital printing onto essentially any media.

BACKGROUND

Current printing systems such as offset lithography and inkjet marking can either print high viscosity inks or variable data but not both. In conventional offset printing, the printing process may include transferring radiation-curable ink onto a portion of an imaging member surface (plate, drum, or the like) that has been selectively coated with a dampening fluid layer according to invariant image data. The dampening fluid typically includes water, but is not limited thereto. The ink is then transferred from the printing plate to a print substrate such as paper, plastic, or metal on which an image is being printed and subsequently cured. However, conventional offset lithographic printing techniques cannot accommodate true high-speed variable data printing processes in which images to be printed change from impression to impression, for example, as enabled by digital printing systems. The lithography process is often relied upon, still, because it provides very high quality printing due to the quality and color gamut of the inks used. Lithographic inks are also less expensive than other inks, toners, and many other types of printing or marking materials.

Inkjet marking systems can print variable data but not using medium or high viscosity inks. Further, a digital system containing a blanket or plate will have difficulties providing cleaning systems capable of reliably and safely removing residual ink from a reimageable surface of the blanket or plate without affecting its longevity. These challenges need to be met in order for variable data printing systems to work efficiently for a wide range of paper media and inks.

As such, there is a need to overcome the deficiencies of conventional printing technology for printing variable data with a wide range of inks and media (e.g., print substrates). It would be beneficial to produce digital prints of high image quality and wear resistance on a wide range of media. Ink-based digital printing is understood to refer to ink-based printing of variable image data for producing images on media that are changeable from one image to a next image with each subsequent printing on the media in an image forming process.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure.

Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing an inkjet printing system that may include an imaging member, a flood coat delivery unit, an inkjet image applicator, a viscosity control unit, and an ink image transfer station. The imaging member may have an imageable surface. The flood coat delivery unit may deposit a flood coat viscose fluid layer of an image receiving coating over the imageable surface. The viscose fluid layer may be a flexographic (flexo) ink layer. The image receiving coating may be a clear flexo ink or a clear lithographic ink. The inkjet image applicator may be positioned downstream of the flood coat delivery unit in a process direction to discharge an ink image onto the flood coat layer. The viscosity control unit may be positioned downstream of the ink image applicator in the process direction to increase the viscosity of the ink image on the flood coat layer and produce a hardened ink image. The ink image transfer station may be positioned downstream of the viscosity control unit in the process direction to transfer the hardened ink image and the flood coat layer from the imageable surface to an image receiving media substrate.

According to aspects illustrated herein, an inkjet printing method may include depositing an image receiving coating over an imageable surface of an imaging member with a flood coat delivery unit to form a flood coat layer, discharging an ink image onto the flood coat layer with an inkjet image applicator positioned downstream of the flood coat delivery unit in a process direction, increasing the viscosity of the ink image on the flood coat layer with a viscosity control unit positioned downstream of the inkjet image applicator in the process direction to produce a hardened ink image, and transferring the hardened ink image and the flood coat layer from the imageable surface to an image receiving media substrate via an ink image transfer station positioned downstream of the viscosity control unit in the process direction.

According to aspects described herein, a system useful in printing may include an imaging member having an imageable surface for carrying a marking material, a processor, and a storage device (e.g., memory) coupled to the processor. The storage device may include instructions operative on the processor for depositing an image receiving coating over an imageable surface of an imaging member with a flood coat delivery unit to form a flood coat layer, discharging an ink image onto the flood coat layer with an inkjet image applicator positioned downstream of the flood coat delivery unit in a process direction, the marking material including the ink image and the flood coat layer, increasing the viscosity of the ink image on the imageable surface with a viscosity control unit positioned downstream of the inkjet image applicator in the process direction, and transferring the marking material from the imageable surface to an image receiving media substrate via an ink image transfer station positioned downstream of the viscosity control unit in the process direction. The storage device may also include instructions operative on the processor for removing the residual ink from the imageable surface with cleaning station positioned downstream the ink image transfer station in the process direction, and increasing the viscosity of the ink on the image receiving media substrate with a second viscosity control unit positioned adjacent the image receiving media substrate downstream the ink image transfer station.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
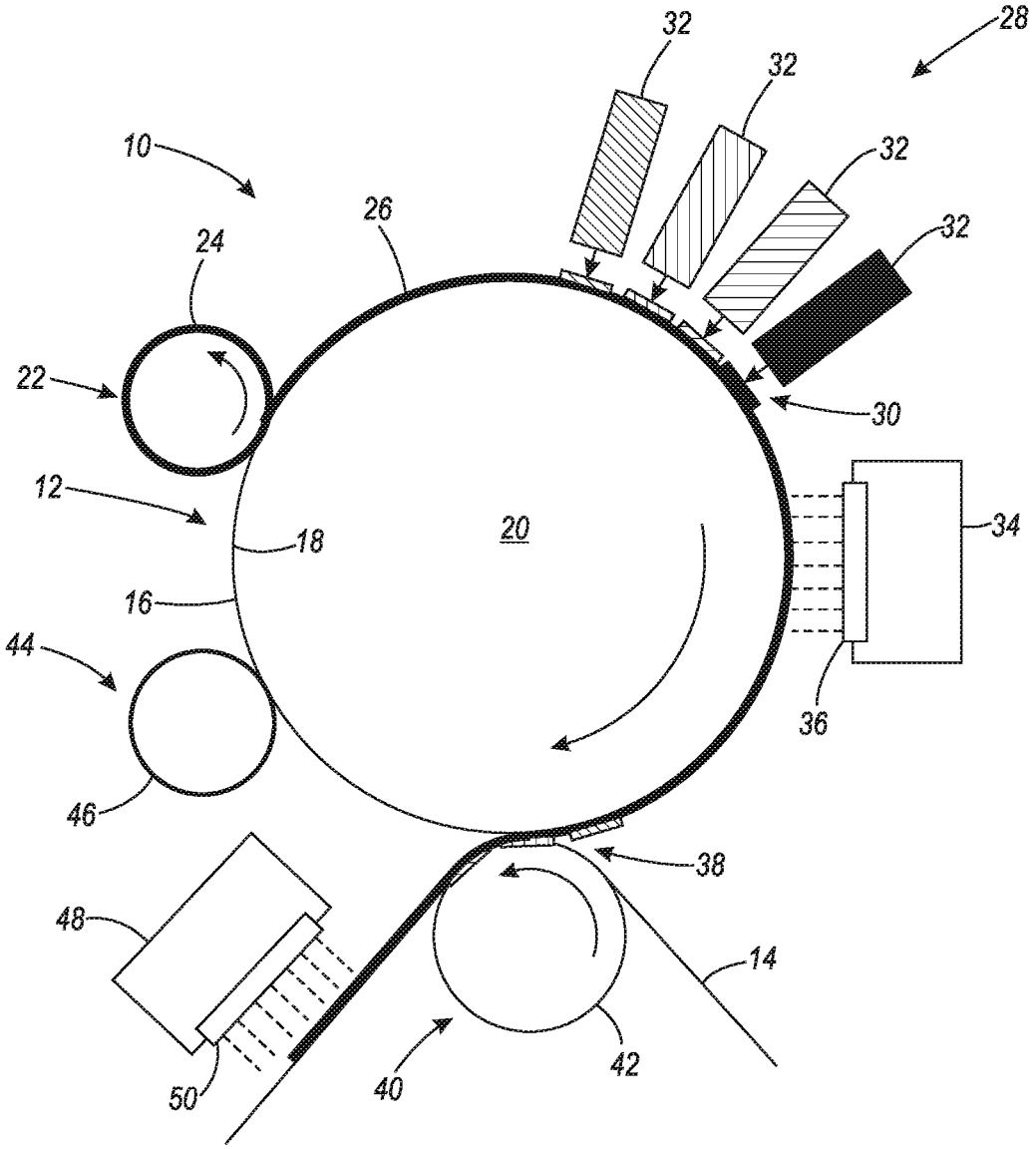
FIG. 1 is a side view of a variable data inkjet printing system in accordance with an example of the embodiments.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The disclosed embodiments include examples intended to cover systems and methods for producing digital ink prints of high image quality and wear resistance on a wide range of media having aspects of both lithographic/flexographic and inkjet printing. The term "high image quality" refers to an image quality (e.g., above 600 DPI) comparable to that of commercial lithographic, flexographic and high end production laser printers. The examples may include a solid (e.g., without reliefs) flexographic blanket used to receive a flood layer of very thin (e.g., about 10 μm or less, 1 to 4 μm) image receiving coating with high viscosity (e.g., greater than 100 cP, or between 1,000 cP to 1,000,000 cP), which may be a clear (e.g., transparent) or substantially clear (e.g., translucent) ultra-violet (UV) coating. The coating may be a flexo ink or a lithographic ink. A digital ink (e.g., UV) image may then be printed on top of the flood layer, for example by jetting low viscosity UV ink (e.g., 5 to 10 cP) on top of the flood coat layer.

While not being limited to a particular theory, the digital ink may have a lower viscosity than the flood coat layer. The lower viscosity UV digital ink may sit on top of the thicker flood coat layer and maintain its location by surface tension interaction with the image receiving coating. The combination of inks and coating is then partially cured to a tacky state at which point it is transferred to the media via a conformable pressure nip. Since the lower viscosity jetted inks are not responsible for directly wetting the media, media latitude widens greatly. Further, the whole process may be considered waterless because the ink and coating materials may contain no water and the ink hardening does not include solvent-removal nor drying.

Although the ink is discussed herein as a UV-curable ink, the disclosed embodiments are not intended to be limited to such a construct. The ink may be a UV-curable ink or another ink that hardens when exposed to a curing operation such as UV radiation. The ink may be another ink having a cohesive bond that increases, for example, by increasing its viscosity.

FIG. 1 depicts a variable data inkjet printing system 10 that may be under the control of a controller 60 for forming an ink image on an intermediate transfer member (e.g., imaging member 12) and subsequently transferring that image from the intermediate transfer member to an image receiving media such as a print substrate 14. The illustrated printing system includes an imaging member 12 having a surface layer 16 formed over a structural mounting layer that may be, for example, a cylindrical core, or one or more structural layers over a cylindrical core. In the exemplary printing system 10 depicted in FIG. 1, the imaging member 12 includes an offset blanket 18 wrapped about a drum 20. The blanket 16, as the surface layer, may be a conformable blanket having an outer imageable surface configured to receive a flood layer of image receiving coating. The imaging member 12 is not limited to a blanket about a drum. For example, the imaging member may be a drum having a micro-roughened smooth outer surface designed to hold marking material such as UV ink. The outer surface may be reimageable, and may also be treated with or otherwise include a non-stick surface coating or conformable surface layer of a fluoroelastomer, silicone elastomer or blend thereof to facilitate transferring onto the print media.

The exemplary printing system 10 includes a flood coat delivery unit 22 that may deposit a layer of an image receiving coating over the imageable surface 16 of the imaging member 12. While not being limited to a particular theory, the flood coat delivery unit 22 may include one or more rollers 24 for uniformly coating the imageable surface with a flood coat layer 26 of the image receiving coating. The flood coat layer 26 may a very thin layer (e.g., less than about 5 μm) of viscous material capable of thickening further under a viscous material thickening process. For example, the viscous material may be a UV curable material, including, for example, a flexo or lithographic UV curable ink. The viscous material may also have a high viscosity (e.g., 100 cP-100,000 cP) when applied by the flood coat delivery unit 22 to the imageable surface 16. The roller 24 may be an anilox roll that deposits the flood coat layer of image receiving coating directly on the imageable surface. Of course other fluid metering devices may be selected as the flood coat delivery unit to apply the very thin flood coat layer 26 according to the viscous material viscosity. The ink used for the flood coat layer 26 may be clear, such as a transparent ink or at least a translucent ink, as the flood coat layer should be see-through, as discussed in greater detail below.

Once the flood coat delivery unit 22 meters the flood coat layer 26 onto the imageable surface 16 of the imaging member 12, an ink image applicator 28 positioned downstream of the flood coat delivery unit in a process direction may discharge an ink image 30 onto the flood coat layer. The ink image applicator 28 may include one or more inkjet print heads 32 that spray or jet marking material (e.g., jettable ink) in an image-wise pattern forming the ink image 30. The marking material may be a UV curable jettable ink having a lower viscosity (e.g., 1-20 cP, less than 30 cP) than the viscous material used for the flood coat layer 26. The jetted marking material (e.g., UV curable jettable ink) has a viscosity suitable for ejection from high resolution print nozzles of the inkjet print heads at, for example above 600 dpi or at least about 1200 dpi to over 1800 dpi.

The ink jet print heads 32 may be supported by an appropriate housing and support elements (not shown). While not being limited to a particular theory, the ink jet print heads may be mounted so as to be stationary, or at most is mounted so as to be a fixed distance from the imageable surface 16 of the imaging member 12 and the flood coat layer 26, but movable axially across the face of the imaging member, for example movable in a direction toward and away from a viewer viewing FIG. 1.

The lower viscosity marking material deposited onto the flood coat layer 26 by the ink image applicator 28 forms the ink image 30. The ink image 30 is an ink layer that sits on top of the flood coat layer 26 and may maintain its location on the higher viscosity viscous material of the flood coat layer, for example, by surface tension interaction with the higher viscosity coating. Further, the wetting quality of the jetted marking material may remain constant regardless of the print media material.

After the ink image 30 is deposited on the flood coat layer 26, both fluid layers (e.g., the ink image and the flood coat layer) may be partially cured to a tacky state, which is beneficial to enable optimal transfer, as will be discussed in greater detail below. A viscosity control unit 34 positioned downstream of the ink image applicator 28 in the process direction increases the viscosity of the ink image on the flood coat layer to produce a hardened ink image. The viscosity control unit 34 may also increase the viscosity of the higher viscosity flood coat layer 26. While not being limited to a particular theory, the viscosity control unit may be a rheological conditioning system including a curing mechanism 36 that may form a partial crosslinking core of the fluid layers on the imageable surface 16 to, for example, increase their adhesive strength relative to the imageable surface layer.

The ink image and flood coat layer material may be irradiated with UV radiation by the curing mechanism 36, such as a UV curing lamp (e.g., standard laser, UV laser, high powered UV LED light source), wavelength tunable photoinitiator, or other UV source, that exposes the ink/coating layers on the imageable surface of the imaging member 12 to an amount of UV light (e.g., # of photons radiation) to partially cure the ink/coating to a tacky state. The curing mechanism may include various forms of optical or photo curing, thermal curing, electron beam curing, drying, or chemical curing. The viscosity control unit 34 is configured to partially cure the layers of ink/coating to a sufficient level for transfer of both the ink image and the flood coat layer from the imageable surface 16 to the print media 14 via pressure at a pressure transfer nip 38.

The level of UV light dosage necessary and sufficient to partially cure the ink/coating may depend on several factors, such as the ink/coating formulation (e.g., UV photo initiator type, concentration), UV lamp spectrum, printer processing speed and amount of ink on the imaging member 12 surface. If the ink layers are insufficiently cured, the ink remains too wet for optimal transfer and will split leaving some ink on the imaging member post attempted transfer. If the ink layers are fully or over cured before transfer, the ink will not have sufficient tackiness to pull off the imageable surface of the imaging member over to the print media. While not being limited to a particular range, for an exemplary UV curing lamp (e.g., about 395 nm LED), the inventors through extensive experimentation found that a range of UV light photons from about 30 mJ/cm2 to 600 mJ/cm2 may sufficiently increase the viscosity of the ink layers on the imaging member surface for subsequent transfer.

An ink image transfer station 40 positioned downstream of the viscosity control unit 34 in the process direction transfers the partially cured hardened ink image and flood coat layer from the imageable surface 16 to the print media 14. The transfer occurs as the print media is passed through the pressure transfer nip 38 between the imaging member 12 and an impression roller 42 such that the layers of ink/coating are brought into physical contact with the print media. With the viscosity and cohesive strength of the ink and coating layers having been modified by the viscosity control unit 34, the layers adhere to the print media and separate from the imageable surface of the imaging member 12. This separation from the imaging member may occur without the use of, or need for, dampening fluid between the coating and the imaging member.

The transferred flood coat layer 26 that previously kept the ink image 30 separate from the imaging member 12 now forms a protective coating over the transferred ink image, with the transferred ink image sandwiched between the flood coat layer and the print media. The transferred flood coat layer thus provides additional wear resistance to the ink image on the print media. It may be beneficial if the viscous material used for the flood coat layer is a transparent or at least a translucent coating, so that the protective coating over the transferred ink image can easily be seen through by an observer. Of course the flood coat layer may be tinted where it is desired to give an appearance of a tinted protective covering over the ink image or even a tinted print media.

Following the transfer of the ink image and flood coat layer to the print media 14 at the transfer nip 38, any residual fluid (e.g., ink or coating) may be removed from the imageable surface 16 of the imaging member 12 to prepare the surface to repeat the lithographic and digital image forming operation. Due to the relative position of the flood coat layer 26 between the jetted ink image 30 and the imageable surface 16, any residual fluid for removal is most likely viscous material from the flood coat layer.

This residual fluid removal is most preferably undertaken without scraping or wearing the imageable surface of the imaging member. Removal of such remaining fluid residue may be accomplished through use of some form of cleaning subsystem 44 adjacent the imageable surface between the ink image transfer station 40 and the flood coat delivery unit 22. Such a cleaning subsystem may include at least a first cleaning member such as a sticky or tacky member 46 in physical contact with the surface of the imaging member 12, with the sticky or tacky member removing residual fluid materials from the imageable surface of the imaging member. The sticky or tacky member may then be brought into contact with a smooth roller (not shown) to which the residual fluids may be transferred from the sticky or tacky member, the fluids being subsequently stripped from the smooth roller by, for example, a doctor blade or other like device and collected as waste. It is understood that the cleaning subsystem 44 is one of numerous types of cleaning stations and that other cleaning stations designed to remove residual ink/coating from the surface of a digital printing system imaging member are considered within the scope of the embodiments. For example, the cleaning station could include at least one roller, brush, web, tacky roller, buffing wheel, etc., as well understood by a skilled artisan.

A second viscosity control unit 48 positioned adjacent the image receiving print media 14 downstream the ink image transfer station 40 may further increase the viscosity of the layers 26, 30 on the print media to produce a final cured image on the print media. The second viscosity control unit 48 may be similar to the viscosity control unit 34, and include a curing mechanism 50, such as a LED, UV lamp, wavelength tunable photoinitiator, or other UV source, to fully cure the ink/coating on the print media 14. As noted above, the curing mechanism may include various forms of optical or photo curing, thermal curing, electron beam curing, drying, or chemical curing.

Figure 2:
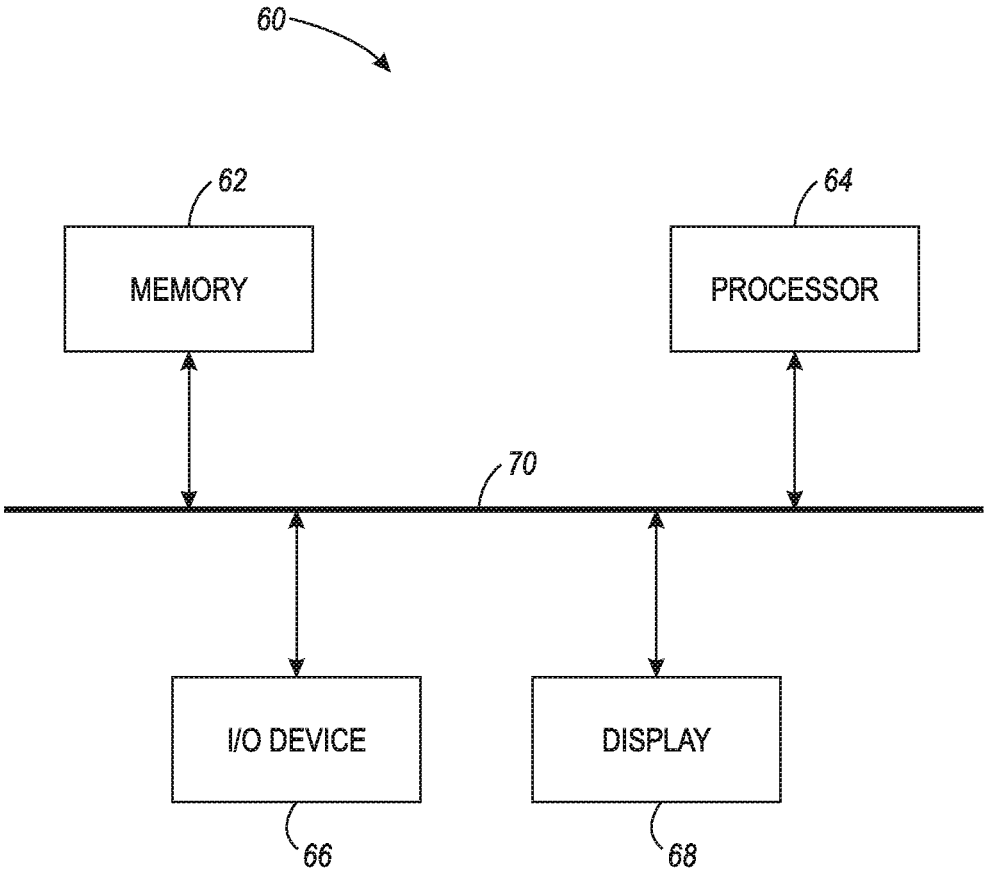
FIG. 2 is a block diagram of a controller with a processor for executing instructions to automatically control devices in the variable data inkjet printing system illustrated by example in FIG. 1.

FIG. 2 illustrates a block diagram of a controller 60 with a processor for executing instructions to automatically control devices in the system illustrated in FIG. 1. The controller 60 is capable of receiving information and instructions from a workstation and from image input devices to coordinate the image formation on the print media 14 through various subsystems such as the flood coat delivery unit 22, the ink image applicator 28, the viscosity control unit 34, and the like. The print media 14 should not be considered to be limited to any particular composition such as, for example, paper, plastic, metal, or composite sheet film. The exemplary system 10 may be used for producing images on a wide variety of image receiving print media.

The controller 60 may be embodied within devices such as a desktop computer, a laptop computer, a handheld computer, an embedded processor, a handheld communication device, or another type of computing device, or the like. The controller 60 may include a memory 62, a processor 64, input/output devices 66, a display 68 and a bus 70. The bus 70 may permit communication and transfer of signals among the components of the controller 60 or computing device.

Processor 64 may include at least one conventional processor or microprocessor that interprets and executes instructions. The processor 64 may be a general purpose processor or a special purpose integrated circuit, such as an ASIC, and may include more than one processor section. Additionally, the controller 60 may include a plurality of processors 64.

Memory 62 may be a random access memory (RAM) or another type of dynamic storage device that stores information and instructions for execution by processor 64. Memory 62 may also include a read-only memory (ROM) which may include a conventional ROM device or another type of static storage device that stores static information and instructions for processor 64. The memory 62 may be any memory device that stores data for use by controller 60.

Input/output devices 66 (I/O devices) may include one or more conventional input mechanisms that permit data between components of the variable data inkjet printing system 10 and for a user to input information to the controller 60, such as a microphone, touchpad, keypad, keyboard, mouse, pen, stylus, voice recognition device, buttons, and the like, and output mechanisms for generating commands, voltages to power actuators, motors, and the like or information to a user such as one or more conventional mechanisms that output information to the user, including a display, one or more speakers, a storage medium, such as a memory, magnetic or optical disk, disk drive, a printer device, and the like, and/or interfaces for the above. The display 68 may typically be a LED, LCD or CRT display as used on many conventional computing devices, or any other type of display device.

The controller 60 may perform functions in response to processor 64 by executing sequences of instructions or instruction sets contained in a computer-readable medium with readable program code, such as, for example, memory 62. Such instructions may be read into memory 62 from another computer-readable medium, such as a storage device, or from a separate device via a communication interface, or may be downloaded from an external source such as the Internet. The controller 60 may be a stand-alone controller, such as a personal computer, or may be connected to a network such as an intranet, the Internet, and the like. Other elements may be included with the controller 60 as needed.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages like Perl or Python. The computer readable program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The memory 62 may store instructions that may be executed by the processor to perform various functions. For example, the memory 62 may store instructions operative on the processor 64 for controlling the activity of the inkjet printing system 10, including depositing an image receiving coating over the imageable surface 16 of the imaging member 12 with the flood coat delivery unit 22 to form the flood coat layer 26, discharging an ink image onto the flood coat layer with the inkjet image applicator 28, increasing the viscosity of the ink image on the flood coat layer with the viscosity control unit 34, and transferring the marking material from the imageable surface to the image receiving print media 14 via an ink image transfer station 40. The memory 62 may also store instructions operative on the processor 64 for removing residual materials from the imageable surface 16 with a cleaning station 44, and increasing the viscosity of the ink/coating on the image receiving print media with a second viscosity control unit 48.

Figure 3:
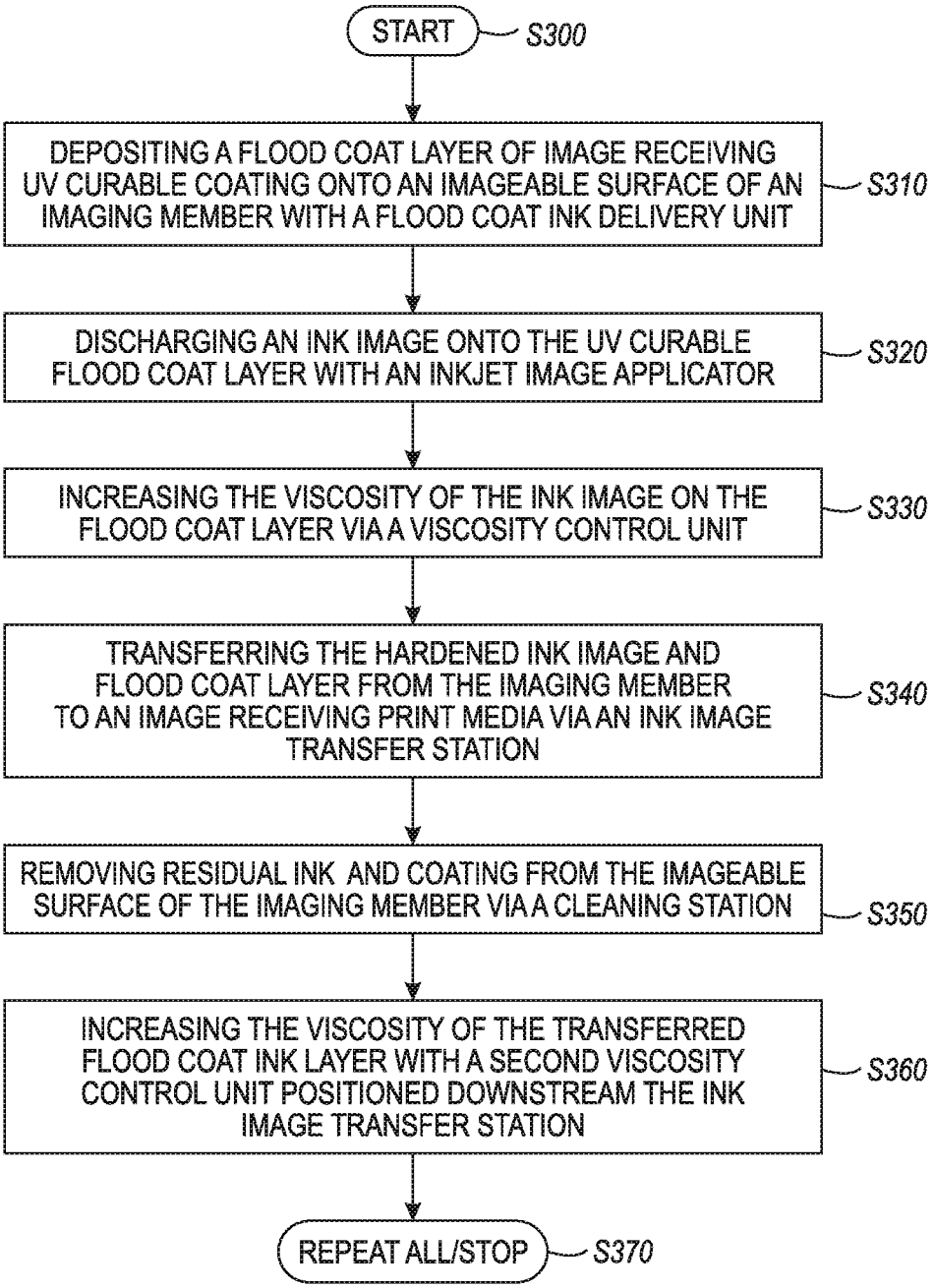
FIG. 3 is a flowchart depicting the operation of an exemplary variable data inkjet printing system.

The disclosed embodiments may include an exemplary inkjet printing method implementing a flood coat layer application and inkjet image forming deposition. FIG. 3 illustrates a flowchart of such an exemplary method. As shown in FIG. 3, operation of the method commences at Step S300 and proceeds to Step S310.

In Step S310, a layer of image receiving coating is deposited onto an imageable surface of an imaging member with a flood coat delivery unit to form a flood coat layer. The layer of image receiving coating viscous material may be transparent or translucent. Operation of the method proceeds to Step S320, where an ink image is discharged onto the flood coat layer with an inkjet image applicator positioned downstream of the flood coat delivery unit in a process direction. Operation of the method proceeds to Step S330.

In Step S330, the viscosity of the ink image on the flood coat layer is increased via a viscosity control unit positioned downstream of the inkjet image applicator in the process direction to produce a hardened ink image. The viscosity of the flood coat layer may also be increased by the viscosity control unit during this step. Operation of the method proceeds to Step S340, where the hardened ink image and the flood coat layer are transferred from the imageable surface to an image receiving print media via an ink image transfer station positioned downstream of the viscosity control unit in the process direction. Operation of the method may proceed to Steps S350 and S360.

In Step S350, any residual ink/coating on the imageable surface of the imaging member may be removed via a cleaning station positioned between the ink image transfer station and the flood coat delivery unit. In Step S360 the viscosity of the transferred flood coat layer may be further increased with a second viscosity control unit positioned adjacent the image receiving print media downstream the ink image transfer station. The viscosity of the transferred hardened ink image on the image receiving print media may also be increased by the second viscosity control unit during this step. Operation may cease at Step S370, or may repeat back to Step S310, where a new layer of image receiving coating may be deposited onto the surface of the imaging member.

The above-described exemplary systems and methods may reference certain conventional image forming device components to provide a brief, background description of image forming approaches that may be adapted to carry into effect the variable data digital control/release agent layer deposition processes in support of the disclosed schemes. No particular limitation to a specific configuration of the variable data printer portions or modules of a residual ink/coating conditioning system is to be construed based on the description of the exemplary elements depicted and described above.

Those skilled in the art will appreciate that other embodiments of the disclosed subject matter may be practiced with many types of image forming elements common to lithographic or inkjet image forming systems in many different configurations. It should be understood that these are non-limiting examples of the variations that may be undertaken according to the disclosed schemes. In other words, no particular limiting configuration is to be implied from the above description and the accompanying drawings.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 3, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An inkjet printing system, comprising:

a flood coat delivery unit that deposits a flood coat layer of an image receiving curable coating over an imageable surface of an imaging member;

an inkjet image applicator positioned downstream of the flood coat delivery unit in a process direction that discharges an ink image onto the flood coat layer;

a viscosity control unit positioned downstream of the ink image applicator in the process direction and configured to increase the viscosity of the ink image on the flood coat layer to produce a hardened ink image; and an ink image transfer station positioned downstream of the viscosity control unit in the process direction that transfers the hardened ink image and the flood coat layer from the imageable surface to an image receiving media substrate.

2. The inkjet printing system of claim 1, wherein the image receiving curable coating includes an UV curable coating.

3. The inkjet printing system of claim 1, wherein the image receiving curable coating includes an ink.

4. The inkjet printing system of claim 1, wherein the image receiving curable coating is waterless.

5. The inkjet printing system of claim 1, further comprising a second viscosity control unit positioned adjacent the image receiving media substrate downstream the ink image transfer station, the second viscosity control unit being configured to increase the viscosity of the image receiving curable coating on the image receiving media substrate.

6. The inkjet printing system of claim 1, wherein the ink image is a digital ink image, and the imageable surface of the imaging member is a reimageable conformable surface layer.

7. The inkjet printing system of claim 1, wherein the flood coat layer includes a layer of translucent ink.

8. The inkjet printing system of claim 7, wherein the flood coat layer includes a layer of transparent ink.

9. The inkjet printing system of claim 1, wherein the ink image includes UV curable ink, and the viscosity control unit is a rheological conditioning system configured to cure the ink image to produce the hardened ink image.

10. An inkjet printing method, comprising:

a) depositing an image receiving curable coating over an imageable surface of an imaging member with a flood coat delivery unit to form a flood coat layer;

b) discharging an ink image onto the flood coat layer with an inkjet image applicator positioned downstream of the flood coat delivery unit in a process direction;

c) increasing the viscosity of the ink image on the flood coat layer with a viscosity control unit positioned downstream of the inkjet image applicator in the process direction to produce a hardened ink image; and d) transferring the hardened ink image and the flood coat layer from the imageable surface to an image receiving media substrate via an ink image transfer station positioned downstream of the viscosity control unit in the process direction.

11. The method of claim 10, wherein step a) includes depositing an ink as the image receiving curable coating over the imageable surface of the imaging member.

12. The method of claim 11, wherein step a) further includes depositing translucent ink as the ink image receiving curable coating over the imageable surface of the imaging member.

13. The method of claim 11, wherein step a) further includes depositing transparent ink as the image receiving curable coating over the imageable surface of the imaging member.

14. The method of claim 10, wherein step a) includes depositing a UV curable coating as the image receiving curable coating over the imageable surface of the imaging member.

15. The method of claim 14, wherein step b) includes discharging a UV curable ink as the digital ink image onto the flood coat layer, and the step c) includes curing the ink image and image receiving UV curable coating on the imageable surface with a rheological conditioning system as the viscosity control unit.

16. The method of claim 15, wherein step a) further includes depositing a waterless UV curable coating as the UV curable coating over the imageable surface of the imaging member with the flood coat delivery unit to form the flood coat layer, and step b) further includes discharging a waterless UV curable ink as the UV curable ink.

17. The method of claim 10, further comprising increasing the viscosity of the image receiving curable coating on the image receiving media substrate with a second viscosity control unit positioned adjacent the image receiving media substrate downstream the ink image transfer station.

18. The method of claim 10, wherein step b) includes discharging a digital ink image onto the flood coat layer with the inkjet image applicator, and the imageable surface of the imaging member is a reimageable conformable surface layer.

19. A system useful in printing, comprising:

a processor; and a storage device coupled to the processor, wherein the storage device includes instructions operative on the processor for:

depositing an image receiving curable coating over an imageable surface of an imaging member with a flood coat delivery unit to form a flood coat layer, discharging an ink image onto the flood coat layer with an inkjet image applicator positioned downstream of the flood coat delivery unit in a process direction, the marking material including the ink image and the flood coat layer, increasing the viscosity of the ink image on the flood coat layer with a viscosity control unit positioned downstream of the inkjet image applicator in the process direction, and transferring the marking material from the imageable surface to an image receiving media substrate via an ink image transfer station positioned downstream of the viscosity control unit in the process direction.

20. The system of claim 19, the storage device further including instructions operative on the processor for:

removing residual ink and image receiving curable coating from the imageable surface with a cleaning station positioned downstream the ink image transfer station in the process direction, and increasing the viscosity of the image receiving curable coating on the image receiving media substrate with a second viscosity control unit positioned adjacent the image receiving media substrate downstream the ink image transfer station.

* * * * *